US012687162B2

(12) United States Patent
Sahm

(10) Patent No.: US 12,687,162 B2
(45) Date of Patent: Jul. 21, 2026

(54) JUMPER LINES WITH PUMPS

(71) Applicant: TPE MIDSTREAM LLC, Tulsa, OK (US)

(72) Inventor: Douglas A. Sahm, Lutz, FL (US)

(73) Assignee: TPE MIDSTREAM LLC, Tulsa, OK (US)

( * ) Notice: Subject to any disclaimer, the term of this patent is extended or adjusted under 35 U.S.C. 154(b) by 0 days.

(21) Appl. No.: 18/723,203

(22) PCT Filed: Dec. 29, 2022

(86) PCT No.: PCT/US2022/054265
§ 371 (c)(1),
(2) Date: Jun. 21, 2024

(87) PCT Pub. No.: WO2023/129662
PCT Pub. Date: Jul. 6, 2023

(65) Prior Publication Data

US 2025/0163908 A1 May 22, 2025

Related U.S. Application Data

(60) Provisional application No. 63/295,188, filed on Dec. 30, 2021.

(51) Int. Cl.
*F04B 15/08* (2006.01)
*F04B 37/18* (2006.01)
*F04B 49/22* (2006.01)

(52) U.S. Cl.
CPC ..... *F04B 49/22* (2013.01); *F04B 15/08* (2013.01); *F04B 37/18* (2013.01)

(58) Field of Classification Search
CPC ..... F04B 49/22; F04B 15/08; F04B 37/18; F04B 9/12; F04B 2015/081; F04B 49/02; F04B 35/04; F04B 35/045; F04B 49/035
See application file for complete search history.

(56) References Cited

U.S. PATENT DOCUMENTS 4,541,787 A * 9/1985 DeLong ..... F04B 17/046 417/418
6,033,192 A 3/2000 Wood
(Continued)

FOREIGN PATENT DOCUMENTS

CN 109707605 A * 5/2019
JP S6298783 U 6/1987
(Continued)

OTHER PUBLICATIONS

International Searching Authority, "International Preliminary Report on Patentability," issued in connection with International Patent Application No. PCT/US2022/054265, mailed on Jun. 20, 2024, 7 pages.
(Continued)

*Primary Examiner* — Dominick L Plakkoottam
(74) *Attorney, Agent, or Firm* — Hanley, Flight & Zimmerman, LLC

(57) ABSTRACT

Example jumper lines with pumps are disclosed herein. An example includes a first pipe having fluid at a first pressure, a second pipe having fluid at a second pressure lower than the first pressure, and a jumper line including: a jumper pipe coupled between the first pipe and the second pipe that bypasses a device between the first pipe and the second pipe; a valve coupled to the jumper pipe, the valve to open to enable the fluid at the first pressure to evacuate to the second pipe until the first pipe is equalized with the second pipe; and a pump coupled to the jumper pipe, the pump to, when activated, move at least a portion of the fluid from the first pipe to the second pipe.

11 Claims, 12 Drawing Sheets

(56) References Cited

U.S. PATENT DOCUMENTS

| | | | | |
|---|---|---|---|---|
| 10,443,586 | B1 * | 10/2019 | Sahm | F04B 49/08 |
| 11,913,437 | B2 * | 2/2024 | Reukers | F04B 11/00 |
| 2005/0019181 | A1 | 1/2005 | Wang | |
| 2007/0110596 | A1 * | 5/2007 | Weeber | F04D 29/058 417/423.12 |
| 2010/0329902 | A1 * | 12/2010 | Thrasher | F04B 47/08 417/375 |
| 2011/0162724 | A1 * | 7/2011 | Kleckler | F02C 7/236 137/115.23 |
| 2012/0251359 | A1 * | 10/2012 | Neelakantan | F04B 11/0058 417/416 |
| 2013/0153038 | A1 * | 6/2013 | Barden | G01M 3/005 137/1 |
| 2021/0355924 | A1 | 11/2021 | Sahm | |

FOREIGN PATENT DOCUMENTS

| | | | |
|---|---|---|---|
| JP | 2005069012 | A | 3/2005 |
| JP | 2015083782 | A | 4/2015 |
| WO | 2011084941 | A2 | 7/2011 |
| WO | 2017021403 | A1 | 2/2017 |
| WO | 2023126040 | A1 | 7/2023 |

OTHER PUBLICATIONS

United Kingdom Intellectual Property Office, "Examination Report under Section 18(3)," issued in connection with United Kingdom Patent Application No. 2411179.1, dated Apr. 16, 2025, 8 pages.

Australian Government, IP Australia, "Examination report No. 1," issued in connection with Australian Patent Application No. 2022426698, dated May 7, 2025, 4 Pages.

European Patent Office, "Extended European Search Report," issued in connection with European Patent Application No. 22917359.6, dated Jul. 1, 2025, 9 pages.

Australian Government, IP Australia, "Notice of Acceptance," issued in connection with Australian Patent Application No. 2022426698, issued on Jul. 31, 2015, 4 pages.

United Kingdom Intellectual Property Office, "Examination Report under Section 18(3)," issued in connection with United Kingdom Patent Application No. GB2411179.1, dated Aug. 29, 2025, 5 pages.

International Searching Authority, "Search Report," issued in connection with Application No. PCT/US2022/054265, dated May 11, 2023, 4 pages.

International Searching Authority, "Written Opinion," issued in connection with Application No. PCT/US2022/054265, dated May 11, 2023, 6 pages.

Kimray Inc, "Glycol Pumps," https://www.dnow.com/hubfs/WC/PDF/Products/Kimray/Kimray_glycol-pumps-cut-sheets.pdf, issued Oct. 2020, retrieved on Jan. 2, 2025, 42 pages.

Kimray Inc, "How the Kimray Energy Exchange Glycol Pump Operates on a Glycol Dehydration System", Youtube, https://youtu.be/SZIr2Esnp-E, Dec. 20, 2018, retrieved on Jan. 2, 2025, 1 page.

United Kingdom Intellectual Property Office, "Intention to Grant under Section 18(4)," issued in connection with United Kingdom Patent Application No. GB2411179.1, dated Feb. 3, 2026, 2 pages.

Canadian Intellectual Property Office, "Examiner Requisition," issued in connection with Canadian Patent Application No. 3,242,668, dated Feb. 12, 2026, 7 pages.

United Arab Emirates Ministry of Economy and Tourism, "Non-Final Rejection," issued in connection with AE Patent Application No. P2024-01716, dated Feb. 23, 2026, 10 pages.

* cited by examiner

JUMPER LINES WITH PUMPS

RELATED APPLICATION

This application claims priority to U.S. Provisional Patent Application No. 63/295,188, titled "Jumper Lines with Pumps," filed Dec. 30, 2021, which is hereby incorporated by reference in its entirety.

FIELD OF THE DISCLOSURE

This disclosure relates generally to jumper lines and, more particularly, to jumper lines with pumps.

BACKGROUND

Buildings, plants, factories, and other facilities commonly use natural gas for various purposes such as for heating (e.g., air heating, water heating, etc.), power generation, transportation, etc. In some instances, such as during maintenance or cleaning, it is desired to evacuate the natural gas from the piping system in the facility. Facilities often vent the natural gas to the atmosphere, which is wasteful and can be harmful to the environment.

BRIEF DESCRIPTION OF THE DRAWINGS

In FIG. 2A an example facility is operating at a higher-pressure.

Figure 1:
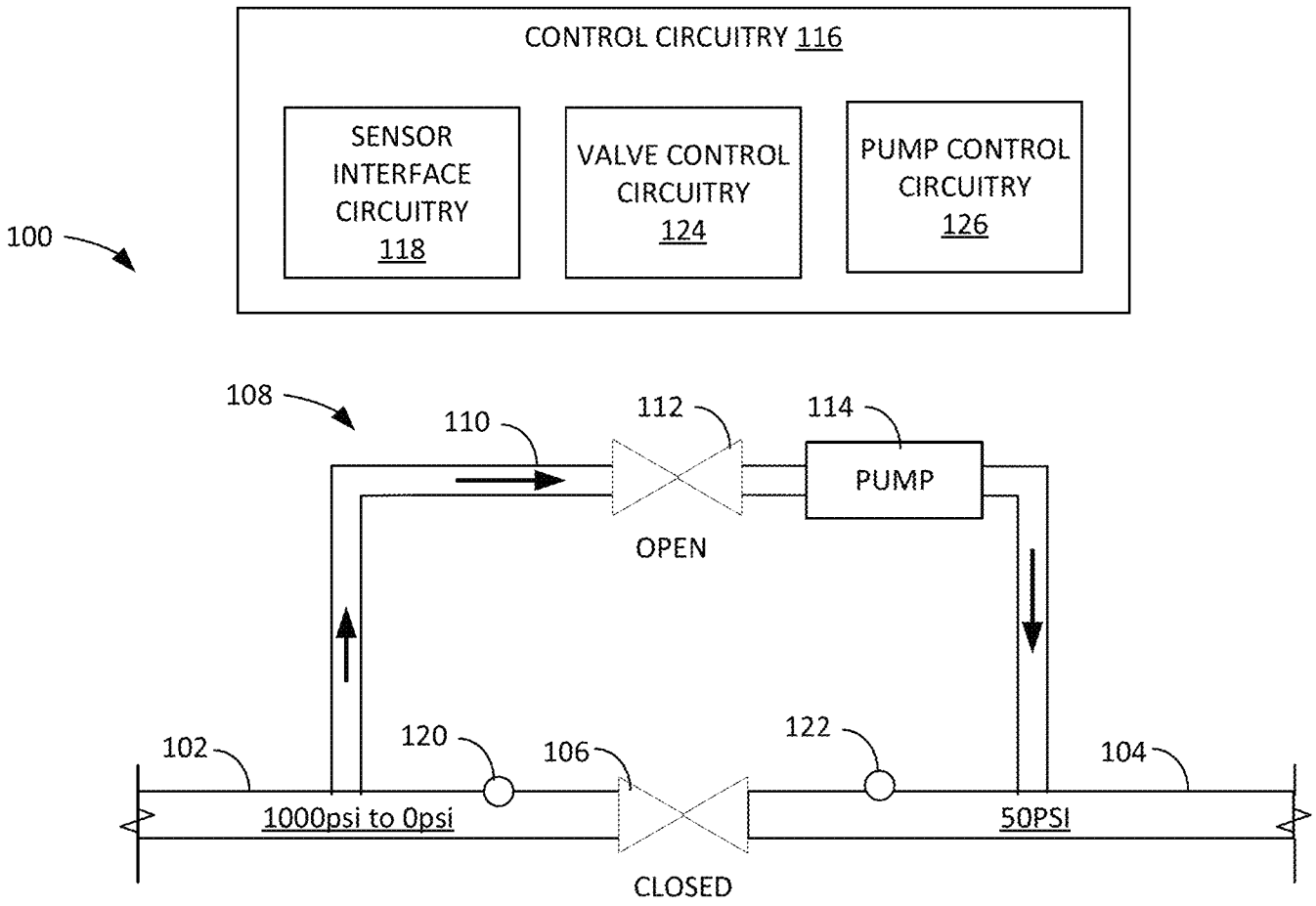
FIG. 1 is a schematic diagram of an example system utilizing an example jumper line with an example pump constructed in accordance with the teachings of this disclosure.

In general, the same reference numbers will be used throughout the drawing(s) and accompanying written description to refer to the same or like parts. The figures are not to scale. Instead, the thickness of the layers or regions may be enlarged in the drawings. Although the figures show layers and regions with clean lines and boundaries, some or all of these lines and/or boundaries may be idealized. In reality, the boundaries and/or lines may be unobservable, blended, and/or irregular.

As used in this patent, stating that any part (e.g., a layer, film, area, region, or plate) is in any way on (e.g., positioned on, located on, disposed on, or formed on, etc.) another part, indicates that the referenced part is either in contact with the other part, or that the referenced part is above the other part with one or more intermediate part(s) located therebetween.

As used herein, connection references (e.g., attached, coupled, connected, and joined) may include intermediate members between the elements referenced by the connection reference and/or relative movement between those elements unless otherwise indicated. As such, connection references do not necessarily infer that two elements are directly connected and/or in fixed relation to each other. As used herein, stating that any part is in "contact" with another part is defined to mean that there is no intermediate part between the two parts.

Unless specifically stated otherwise, descriptors such as "first," "second," "third," etc., are used herein without imputing or otherwise indicating any meaning of priority, physical order, arrangement in a list, and/or ordering in any way, but are merely used as labels and/or arbitrary names to distinguish elements for ease of understanding the disclosed examples. In some examples, the descriptor "first" may be used to refer to an element in the detailed description, while the same element may be referred to in a claim with a different descriptor such as "second" or "third." In such instances, it should be understood that such descriptors are used merely for identifying those elements distinctly that might, for example, otherwise share a same name.

As used herein, the phrase "in communication," including variations thereof, encompasses direct communication and/or indirect communication through one or more intermediary components, and does not require direct physical (e.g., wired) communication and/or constant communication, but rather additionally includes selective communication at periodic intervals, scheduled intervals, aperiodic intervals, and/or one-time events.

As used herein, "processor circuitry" is defined to include (i) one or more special purpose electrical circuits structured to perform specific operation(s) and including one or more semiconductor-based logic devices (e.g., electrical hardware implemented by one or more transistors), and/or (ii) one or more general purpose semiconductor-based electrical circuits programmed with instructions to perform specific operations and including one or more semiconductor-based logic devices (e.g., electrical hardware implemented by one or more transistors). Examples of processor circuitry include programmed microprocessors, Field Programmable Gate Arrays (FPGAs) that may instantiate instructions, Central Processor Units (CPUs), Graphics Processor Units (GPUs), Digital Signal Processors (DSPs), XPUs, or microcontrollers and integrated circuits such as Application Specific Integrated Circuits (ASICs). For example, an XPU may be implemented by a heterogeneous computing system including multiple types of processor circuitry (e.g., one or more FPGAs, one or more CPUs, one or more GPUs, one or more DSPs, etc., and/or a combination thereof) and application programming interface(s) (API(s)) that may assign computing task(s) to whichever one(s) of the multiple types of the processing circuitry is/are best suited to execute the computing task(s).

DETAILED DESCRIPTION

Disclosed herein are example jumper lines including pumps that can be used to evacuate or move fluid from one location to another location, such as from a higher-pressure area to a lower-pressure area or from a lower-pressure area to a higher-pressure area. A jumper line, sometimes referred to as a bypass line or a high-to-low line, is a line (e.g., pipe, tube, conduit, etc.) that bypasses a valve or other device and connects to locations typically having different pressures. A jumper line is commonly used to vent a high-pressure area to a lower-pressure area. For example, a facility that utilizes high-pressure natural gas may desire to drain the natural gas from their facility for cleaning. The facility can use a jumper line between the factory's system and the main supply line to enable the high-pressure natural gas from the facility's system to vent back into the supply line. However, the jumper line only enables the gas to equalize to the pressure in the main supply line. As such, the facility's system is not completely evacuated and may still need to be vented. Therefore, disclosed herein are example jumper lines that include a pump. The pump is coupled to and/or otherwise integrated with the jumper line. The pump can be activated to evacuate the rest of the fluid from to the main supply line (which may be at a higher pressure). As such, all or almost all of the fluid can be evacuated from the high-pressure side. As a result, the facility does not need to vent the natural gas to the atmosphere.

Example jumper lines with pumps disclosed herein can be used in various other application as a well. Example pumps disclosed herein include solenoid operated pumps, hydraulic pumps, pneumatic pumps, and/or electrically-powered pumps. The examples disclosed herein are described in connection with natural gas as the fluid. However, any of the examples disclosed herein can also be used in connection with other fluids such as water, oil, etc. Therefore, the examples disclosed herein are not limited to natural gas applications.

FIG. 1 shows an example system 100 (e.g., a piping system or network) having a first pipe 102 with fluid at a first pressure and a second pipe 102 with fluid at a second pressure that is lower than the first pressure. For example, the first pressure may be at 1000 pounds per square inch (psi) and the second pressure may be at 50 psi. The first and second pipes 102, 104 can represent any vessel or area containing fluid that can be isolated from each other. In this example, the system 100 includes a valve 106 coupled between the first and second pipes 102, 104. The valve 106 is in a closed position, which separates the high-pressure fluid from the low-pressure fluid. Additionally or alternatively, one or more other devices can be disposed between the first and second pipes 102, 104. For example, in addition to or as an alternative to the valve 106, a compressor and/or a pressure regulator can be disposed between the pipes 102, 104. It may be desired to vent the fluid from the first pipe 102 into the second 104 without or before opening the valve 106. For example, if the valve 106 is a large isolation valve, it may be damaging to the valve 106 to open the valve 106 with such a large pressure difference. Therefore, it may be desired to vent some of the pressure from the first pipe 102 into the second pipe 104 before opening the valve 106. As another example, the first pipe 102 may represent a facility that operates using high-pressure fluid, and the second pipe 104 may represent a supply line that supplies fluid to the facility at a lower-pressure. It may be desirable to vent the high-pressure fluid back into the supply line before performing maintenance or cleaning on the facility.

In the illustrated example, the system 100 includes a jumper line 108 that is fluidly coupled between the first and second pipes 102, 104 and bypasses the valve 106. In particular, the jumper line 108 includes a jumper pipe 110, which may be implemented as any pipe, tube, conduit, etc. The jumper pipe 110 is fluidly coupled between the first pipe 102 and the second pipe 104 that bypasses the valve 106 between the first pipe 102 and the second pipe 104. The jumper line 108 includes a valve 112 coupled to the jumper pipe 110 (or coupled between two sections of the jumper pipe 110). When it is desired to evacuate or vent the contents of the first pipe 102, the valve 112 is opened, which enables the high-pressure fluid in the first pipe 102 to flow to the second pipe 104. In some examples, the second pipe 104 may be relatively large and unaffected by the added contents, such that the fluid in the second pipe 104 remains at about 50 psi. The fluid at the first pressure in the first pipe 102 evacuated to the second pipe 104 until the first pipe 102 is equalized with the second pipe 104. Therefore, the first pipe 102 becomes pressure balanced down to about 50 psi with the second pipe 104.

In some situations, it may be desired to completely or almost completely evacuate the first pipe 102. Therefore, in the illustrated example, the jumper line 108 includes a pump 114. The pump 114 is coupled to or integrated with the jumper pipe 110. The pump 114 is disposed between the valve 112 and the second pipe 104. The pump 114 can include one or more check valves (sometimes referred to as one-way valves) that only allow fluid to flow from the first pipe 102 to the second pipe 104. Therefore, when the valve 112 is open, the fluid in the first pipe 102 can flow freely through the pump 114 to the second pipe 104, but cannot flow in the reverse direction. The pump 114 can also be activated to move at least a portion of the fluid from the first pipe 102 to the second pipe 104. In particular, the pump 114 can be activated to pump or drive the remaining contents of the first pipe 102 to the second pipe 104. Therefore, if it is desired to fully or nearly fully evacuate the first pipe 102 or decrease the pressure to a lower pressure than the second pipe 104, the pump 114 can be activated to further move the remaining fluid from the first pipe 102 to the second pipe 104. In some examples, the first pipe 102 can be drained from 50 psi down to 0 psi or about 0 psi. The pump 114 essentially activates or energizes the jumper line 108, thereby making the jumper line 108 an active fluid transfer device rather than a purely passive fluid transfer device. This eliminates or significantly reduces the amount of fluid (e.g., hydrocarbons) that is vented to the atmosphere compared to known systems.

The jumper line 108 can also be used to move fluid from a lower pressure to a higher pressure. For example, the jumper line 108 could be connected in the reverse direction to evacuate the fluid in the second pipe 104 and move it into the first pipe 102. In some examples, the pump 114 can operate to pump or drive fluid in either direction.

In the illustrated example, the network 100 includes example control circuitry 116 for controlling one or more devices. In the illustrated example, the control circuitry 116 includes example sensor interface circuitry 118. The sensor interface circuitry 118 receives sensor data (e.g., measurements) from one or more sensors. For example, the network 100 includes a first sensor 120 that measures the pressure of the fluid in the first pipe 102, and a second sensor 122 that measures the pressure of the fluid in the second pipe 104. The control circuitry 116 can use the sensor data to control one or more devices. In the illustrated example, the control circuitry 116 includes example valve control circuitry 124 and example pump control circuitry 126. The valve control circuitry 124 controls the valve 106 and the valve 112. For example, the valve control circuitry 124 can control or activate one or more actuators associated with the valves 106, 112. The pump control circuitry 126 controls activation and deactivation of the pump 114. During an example evacuation process, the valve control circuitry 124 causes the valve 106 to close or maintains the valve 106 in a closed position. Then, the valve control circuitry 124 causes the valve 112 to open to enable fluid to flow through the jumper line 108 between the first pipe 102 and the second pipe 104. The sensor interface circuitry 118 receives pressure measurements from the first and second sensors 120, 122. In some examples, the sensor interface circuitry 118 determines when the pressures are equalized, and, when the pressures are equalized, the pump control circuitry 126 causes the pump 114 to activate to evacuate the remaining fluid from the first pipe 102 to the second pipe 104. In other examples, the pump control circuitry 126 can cause the pump 114 to activate while the pressures are equalizing to help speed up the process. In some examples, the sensor interface circuitry 118 monitors the pressures and the valve control circuitry 124 causes the valve 112 to close when a predetermined pressure is reached in the first pipe 102, such as 0 psi or close to 0 psi (e.g., 0.2 psi).

Figure 2A:
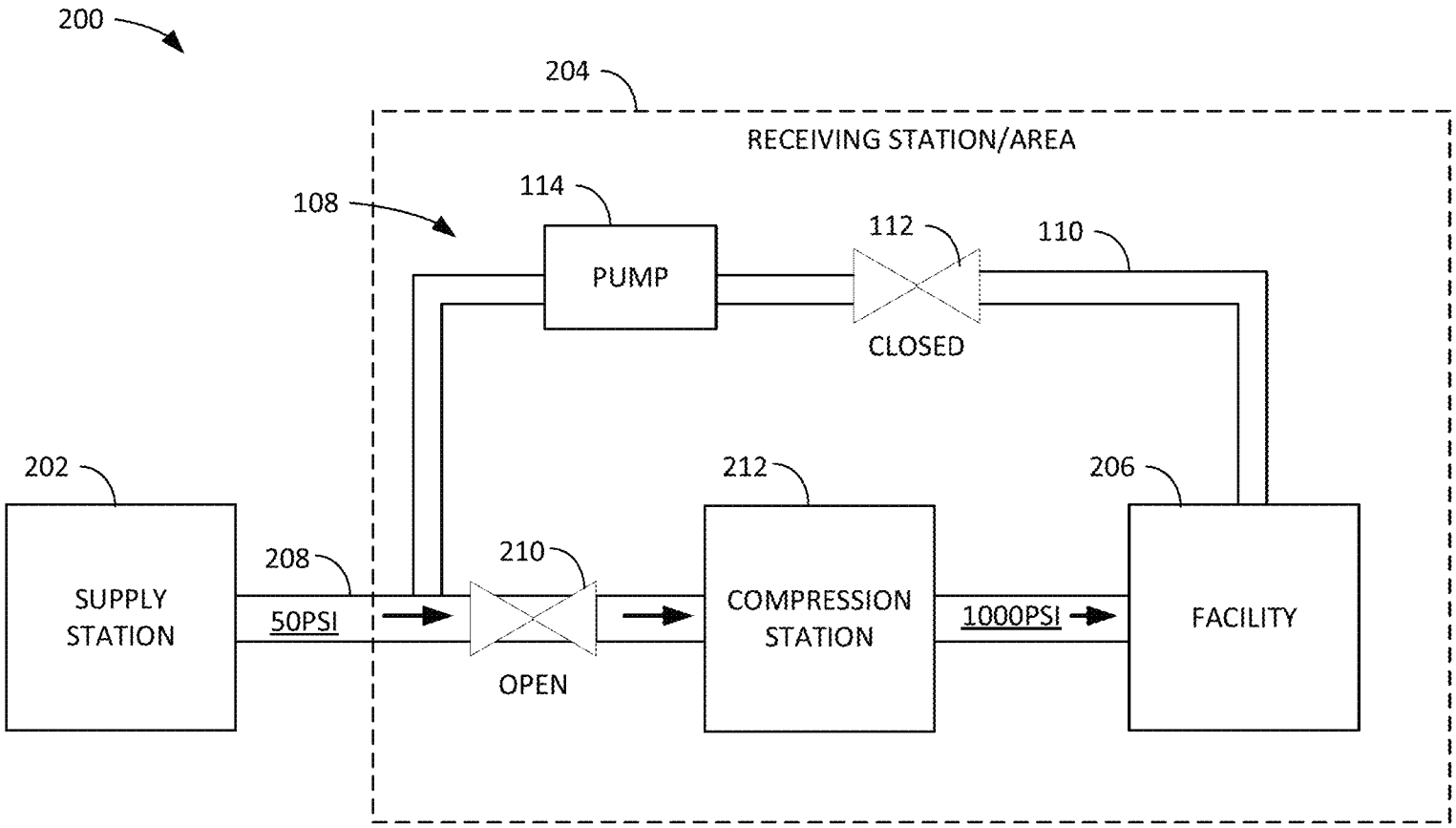
FIG. 2A is a schematic diagram of an example gas distribution network that can employ the example jumper line of FIG. 1.

The control circuitry 126 of FIG. 1 may be instantiated (e.g., creating an instance of, bring into being for any length of time, materialize, implement, etc.) by processor circuitry such as a central processing unit executing instructions. Additionally or alternatively, the control circuitry 126 of FIG. 1 may be instantiated (e.g., creating an instance of, bring into being for any length of time, materialize, implement, etc.) by an ASIC or an FPGA structured to perform operations corresponding to the instructions. It should be understood that some or all of the circuitry of FIG. 1 may, thus, be instantiated at the same or different times. Some or all of the circuitry may be instantiated, for example, in one or more threads executing concurrently on hardware and/or in series on hardware. Moreover, in some examples, some or all of the circuitry of FIG. 1 may be implemented by microprocessor circuitry executing instructions to implement one or more virtual machines and/or containers FIG. 2A is a schematic of an example gas distribution system or network 200 that can employ the example jumper line 108. The network 200 includes a supply station 202. The supply station 202 supplies gas to one or more receiving areas. The supply station 202 can be a natural gas refinery and/or pipeline network that distributes natural gas. In this example, the supply station 202 supplies natural gas at around 50 psi. The supply station 202 can supply natural gas to the receiving areas via pipelines (e.g., underground pipelines).

One example receiving station/area 204 is shown in FIG. 2A. The receiving station/area 204 can represent any location that receives natural gas. For example, the receiving station/area 204 can be building (e.g., a factory, a manufacturing plant, a house, a school, etc.), a power generation plant, and/or a general area (e.g., another distribution network, a neighborhood, a city block, etc.). The receiving station/area 204 includes an example facility 206 that uses the natural gas. The facility 206 can be any building, device, equipment, pipe or section of pipe, etc. that uses the natural gas. For example, the facility 206 can be a gas furnace, a generator, etc. As another example, the facility 206 can represent a pipe or section of pipe having the natural gas. In the illustrated example, the supply station 202 provides natural gas to the receiving station/area 204 via a pipeline 208. The pipeline 208 can represent any number of pipelines or a network of pipelines between the supply station 202 and the receiving station/area 204. While in this example only one receiving station/area 204 is shown, it is understood that the supply station 202 can similarly supply natural gas to numerous downstream receiving areas.

In the illustrated example, the network 200 includes a valve 210. The valve 210 can be opened to allow the receiving station/area 204 to receive natural gas, or can be closed to isolate the receiving station/area 204 from the flow of natural gas. In some examples, the valve 210 is the main shutoff valve between the pipeline 208 and the receiving station/are 204. In this example, the valve 210 is part of the receiving station/area 204. However, in other examples, the valve 210 can be disposed upstream from or outside of the receiving station/area 204.

In some instances, it is desired to increase the pressure of the natural gas. For example, it may be desired to increase the pressure for use by the facility 206. As another example, it may be desired to increase the pressure for distribution through another gas distribution network. In the illustrated example, the network 200 includes a compression station 212 (e.g., having one or more compressors). The compression station 212 increase the pressure received from the pipeline 208. For example, in this example, the compression station 212 increases the pressure of the natural gas from 50 psi to 1000 psi to be received and used by the facility 206. In this example the compression station 212 is part of the receiving station/area 204. However, in other examples, the compression station 212 can be located outside of the receiving station/area 204. Therefore, in this example, the compression station 212 and the facility 206 correspond to the first pipe 102 of FIG. 1 having higher-pressure fluid, and the supply station 202 and the pipeline 208 correspond to the second pipe 104 of FIG. 1 having lower-pressure fluid.

In some examples, it may be desired to evacuate the natural gas from the receiving station/area 204. For example, the facility 206 may be shut down for a period of time for cleaning or maintenance. Therefore, the natural gas needs to be evacuated from the receiving station/area 204. Rather than venting the natural gas to the atmosphere, the natural gas can be vented or supplied back to the pipeline 208, which can then be distributed to other receiving areas and used.

In the illustrated example, the receiving station/area 204 includes the jumper line 108 fluidly coupled between the facility 206 and the pipeline 208. In particular, the jumper pipe 110 fluidly connects the facility 206 back to the pipeline 208, and bypasses the valve 210. During normal operation, the valve 112 of the jumper line 108 is closed. In other examples, the jumper line 108 can be coupled between other portions of the receiving station/area 204 and the pipeline 208 (e.g., during repair or replacement of a section of the pipeline 208). The network 200 may utilize the control circuitry 116 of FIG. 1, and one or more sensors (e.g., pressure sensors) can be distributed around the network 200.

Figure 2B:
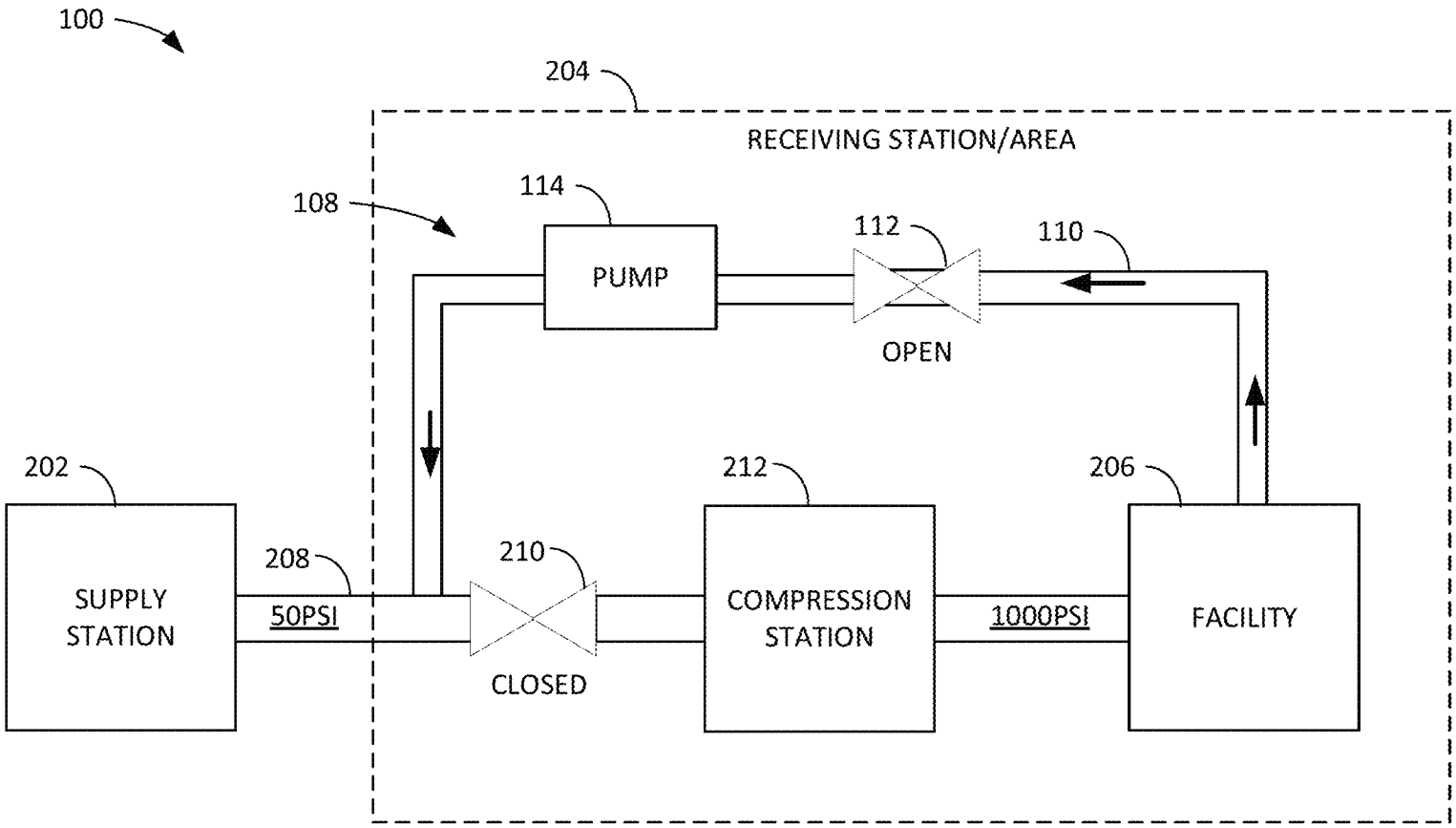
FIGS. 2B and 2C show the example jumper line evacuating (depressurizing) the gas from the example facility.

Referring to FIG. 2B, when it is desired to evacuate the natural gas from the facility 206, the control circuitry 116 causes the valve 210 to close and the compression station 212 is deactivated. The valve 210 is upstream of the facility 206, which isolates the facility 206 from the pipeline 208. Then, after the valve 210 is close, the control circuitry 116 causes the valve 112 to open, which enables the fluid in the facility 206 (the high-pressure natural gas at 1000 psi) to evacuate or vent back to the pipeline 208 until the facility 206 is equalized with the pipeline 208. As disclosed above, the pump 114 may have one or more check valves that enable the natural gas to flow freely through the pump and back to the pipeline 208.

Figure 2C:
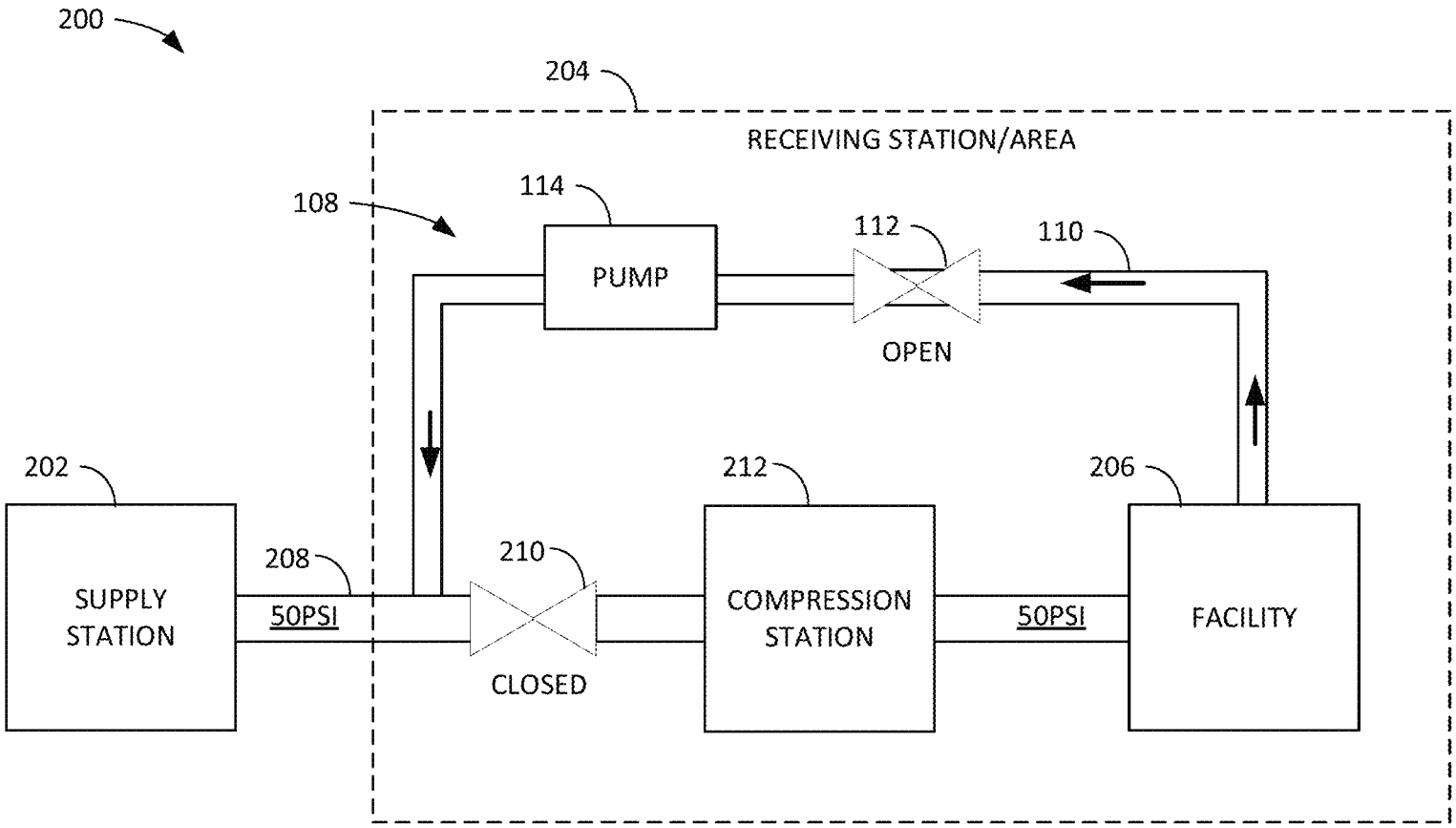

As shown in FIG. 2C, after a period of time, the facility 206 becomes pressure balanced with the pipeline 208. In particular, in this example, the pressure of the natural gas in the facility 206 drops down to the same pressure as the pipeline 208, such as 50 psi.

Figure 2D:
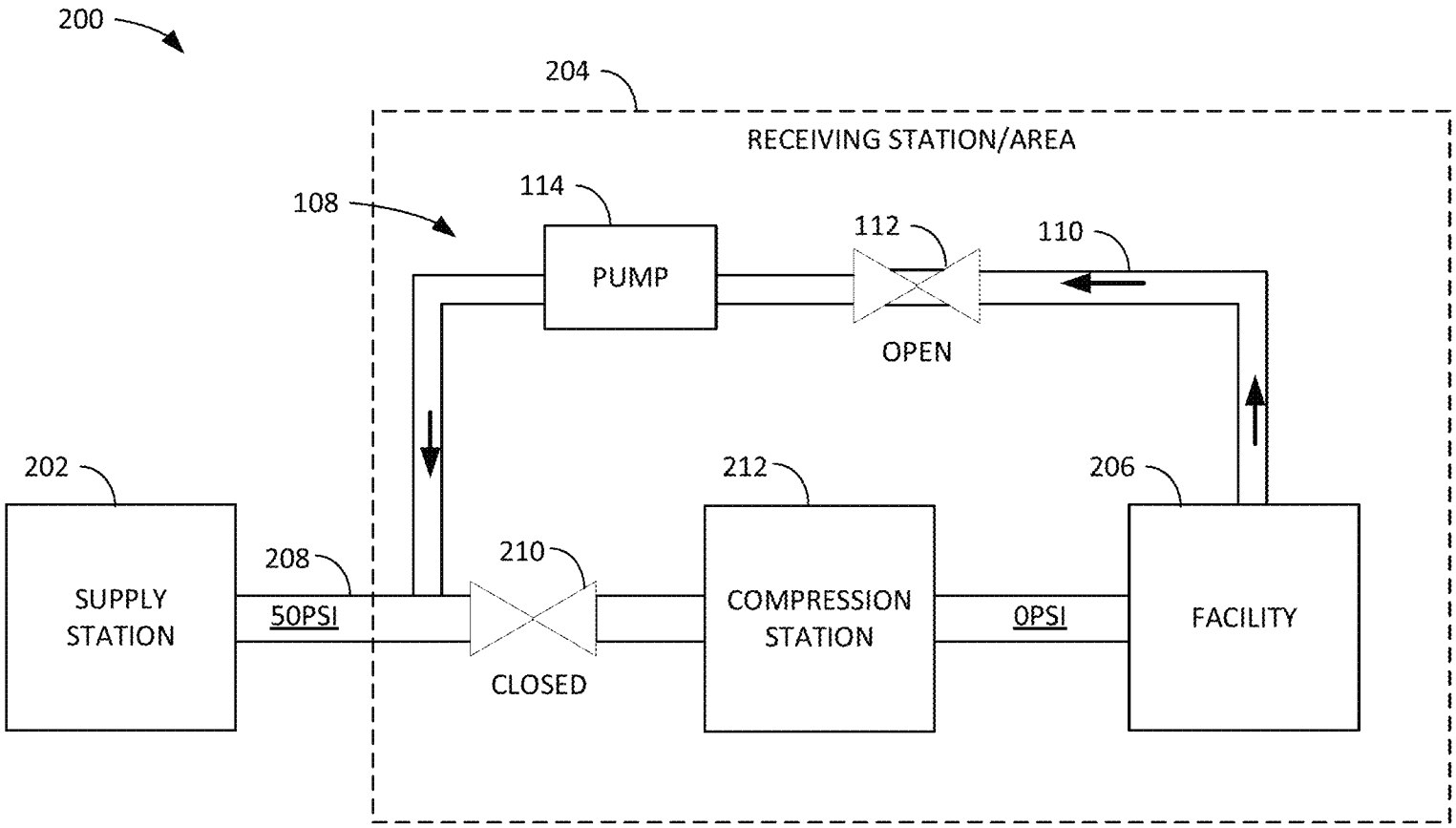
FIG. 2D shows the example jumper line being activated to further evacuate the gas from the example facility.

In some instances, the valve 210 can then be closed, and the remaining 50 psi pressure in the facility 206 can be vented to atmosphere. However, to avoid venting harmful hydrocarbons to the atmosphere, the control circuitry 116 causes the pump 114 to activate to move at least a portion of the fluid from the facility 206 to the pipeline 208. For example, the pump 114 can be activated to transfer the remaining natural gas from the facility 206 back to the pipeline 208. For example, as shown in FIG. 2D, while the valve 112 is open, the pump 114 can be activated, which pumps the remaining 50 psi contents from the facility 206 back to the pipeline 208. In some examples, the pump 114 is activated until the pressure of the natural gas in the facility 206 is down to 0 psi (or a pressure near zero), thereby evacuating all or almost all of the natural gas from the receiving station/are 204. The pump 114 essentially activities or powers the jumper line 108, thereby making the jumper line 108 an active fluid transfer device. As a result, the natural gas from the facility 206 is safely transferred back to the pipeline 208, which can then be used by other resources. This eliminates or significantly reduces the amount of natural gas vented to the atmosphere as seen in known systems.

While in this example the receiving station/area 204 is a higher-pressure area, in other examples, the receiving station/area 204 could be a lower-pressure area. For example, the compression station 212 could instead be a pressure regulator that reduces the inlet pressure of 50 psi down to 10 psi for the facility 206. If it is desired to vent the 10 psi from the facility 206, the pump 114 of the jumper line 108 can be activated to pump the remaining gas from the facility 206 back into the pipeline 208. Further, in some examples, the pump 114 is configured to pump fluid in either direction. Therefore, the jumper line 108 can be used to move fluid between the facility 206 and the pipeline 208 in either direction.

This arrangement of using a pump on a jumper line can be used in other applications as well. In particular, the arrangement can be used in connection with a jumper line on any type of system having a pressure differential where it is desired to move all or almost all of a fluid from one location to another location.

Figure 3:
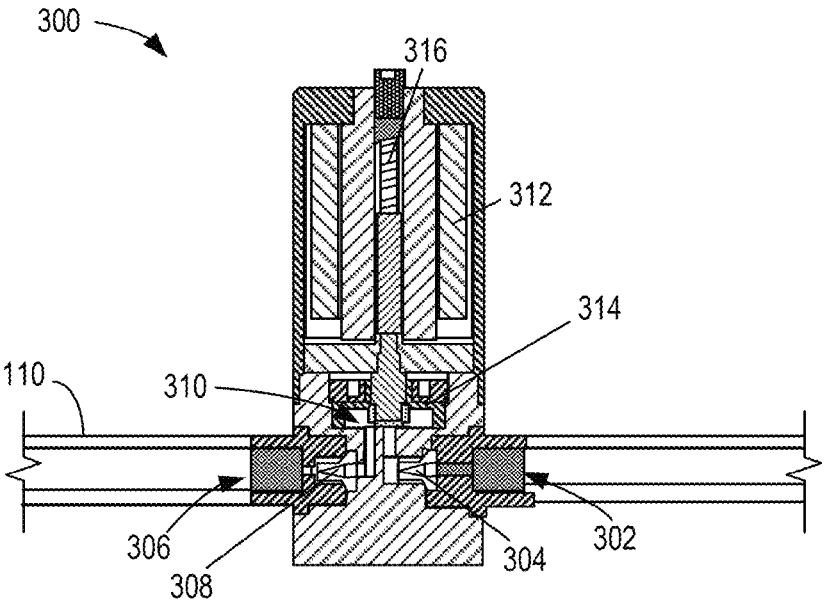
FIG. 3 illustrates an example solenoid operated pump that can be implemented in the example jumper line of FIG. 1.

The pump 114 can be implemented by any type of pump. In some examples, the pump 114 is implemented as solenoid operated pump. FIG. 3 shows an example of a solenoid operated pump 300 that can be implemented as the pump 114. The pump 300 is coupled to the jumper pipe 110 (e.g., coupled between upstream and downstream sections of the jumper pipe 110). The pump 300 includes an inlet 302 with a first check valve 304 and an outlet 306 with a second check valve 308. The check valves 304, 308 are arranged to only allow fluid to flow from the inlet 302 to the outlet 306. When the jumper pipe 110 is opened by the valve 112, fluid can flow through the pump 300 from the high-pressure side to the low-pressure side.

In the illustrated example, the pump 300 includes a chamber or passageway 310 between the two check valves 304, 308. The pump 300 includes a solenoid 312 that moves a diaphragm 314 (e.g., a piston, membrane, etc.) to change the size/volume of the passageway 310. In this example, when the solenoid 312 is activated, the diaphragm 314 is moved upward, which draws fluid through the first check valve 304 from the inlet 302 and into the passageway 310. When the solenoid 312 is deactivated, a return spring 316 moves the diaphragm 314 in the opposite direction, downward, which pushes the fluid in the passageway 310 through the second check valve 308 to the outlet 308. The solenoid 312 can be activated and deactivated at a relatively high frequency to move fluid through the pump 300. In other examples, the solenoid 312 can be configured to move the diaphragm 314 downward when activated and the return spring 316 moves the diaphragm 314 in the opposite direction. In other examples, the solenoid 312 can be a dual-acting solenoid that is energized in both directions.

Figure 4A:
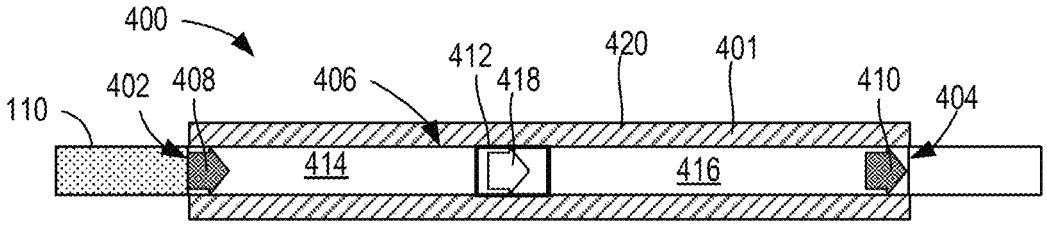
FIGS. 4A-4D illustrate example operations an example in-line pump that can be implemented in the example jumper line of FIG. 1.
Figure 4B:
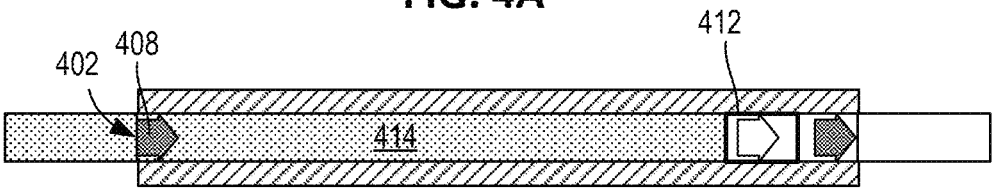
Figure 4C:
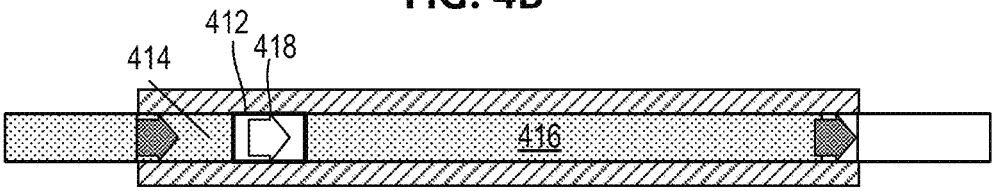
Figure 4D:
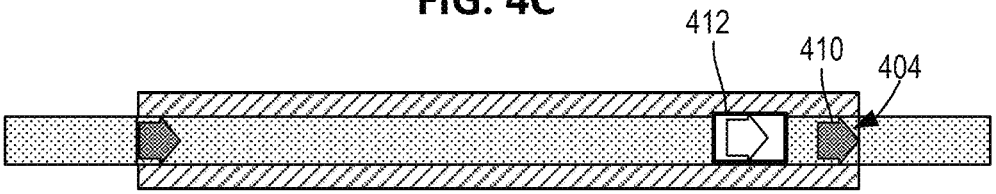

FIG. 4A illustrates another example pump 400 that can be implemented as the pump 114. The example pump 400 has an inline or axial configuration. The pump 400 has a body 401 defining an inlet 402 and an outlet 404 connected by a chamber 406. The pump 400 is coupled to the jumper pipe 110 (e.g., coupled between upstream and downstream sections of the jumper pipe 110). A first check valve 408 is fixed at the inlet 402, and a second check valve 410 is fixed at the outlet 404. The pump includes a piston 412 that is axially moveable in the chamber 406. The piston 412 divides the chamber 406 into a first chamber portion 414 (which is between the first check valve 408 and the piston 412) and a second chamber portion 416 (which is between the piston 412 and the second check valve 410). The piston 412 has a check valve 418 that allows fluid to pass from the first chamber portion 414 to the second chamber portion 416. The pump 400 includes a coil 420 that surrounds the chamber 406. The coil 420 can be embedded in the body 401 of the pump 400. The piston 412 is constructed of a magnetic or ferromagnetic material. The coil 420 can be activated (e.g., via AC to controlled DC power) to move the piston 412 linearly in the chamber 406 in a reciprocating action to pump fluid between the inlet 402 and the outlet 404. For example, as shown in FIG. 4B, the piston 412 is moved to the right, which increases the volume of the first chamber portion 414 and, therefore, draws fluid from the inlet 402 and through the first check valve 408. Then, as shown in FIG. 4C, the piston 412 is moved to the left, which causes the fluid in the first chamber portion 414 to pass through the check valve 418 and into the second chamber portion 416. Then, as shown in FIG. 4D, the piston 412 is moved back to the right, which pushes the fluid in the second chamber portion 416 through the second check valve 410 and out the outlet 404. The coil 420 can be activated to move the piston 412 back-and-forth rapidly to continuously pump fluid from the inlet 402 to the outlet 404. In some examples, the coil 420 only moves the piston 412 in one direction, and a return spring is used to move the piston 412 in the opposite direction when the coil 420 is deactivated.

In other examples, the piston 412 can be driven by another mechanism. For example, the piston 412 can be an annular, air-driven piston. For example, instead of a coil, the chamber 406 can be surrounded by an inflatable bellows. The bellows can be controlled (e.g., inflated and deflated) to move the piston 412 back-and-forth in the chamber 406. The pump 114 can be implemented as other types of pumps or compressors, such as a linear compressor. The pump or compressor can be hydraulically, pneumatically, and/or electrically powered.

In some examples, the pump 114 is implemented as a pneumatic pump (sometimes referred to as an air-driven pump). In some facilities, there are one or more lines of compressed air routed throughout the facility for used by various equipment (e.g., valves). In some examples, this source of compressed air can be used to drive the pump 114. This reduces or eliminates the need for electrical power at or near the pump 114.

Figure 5:
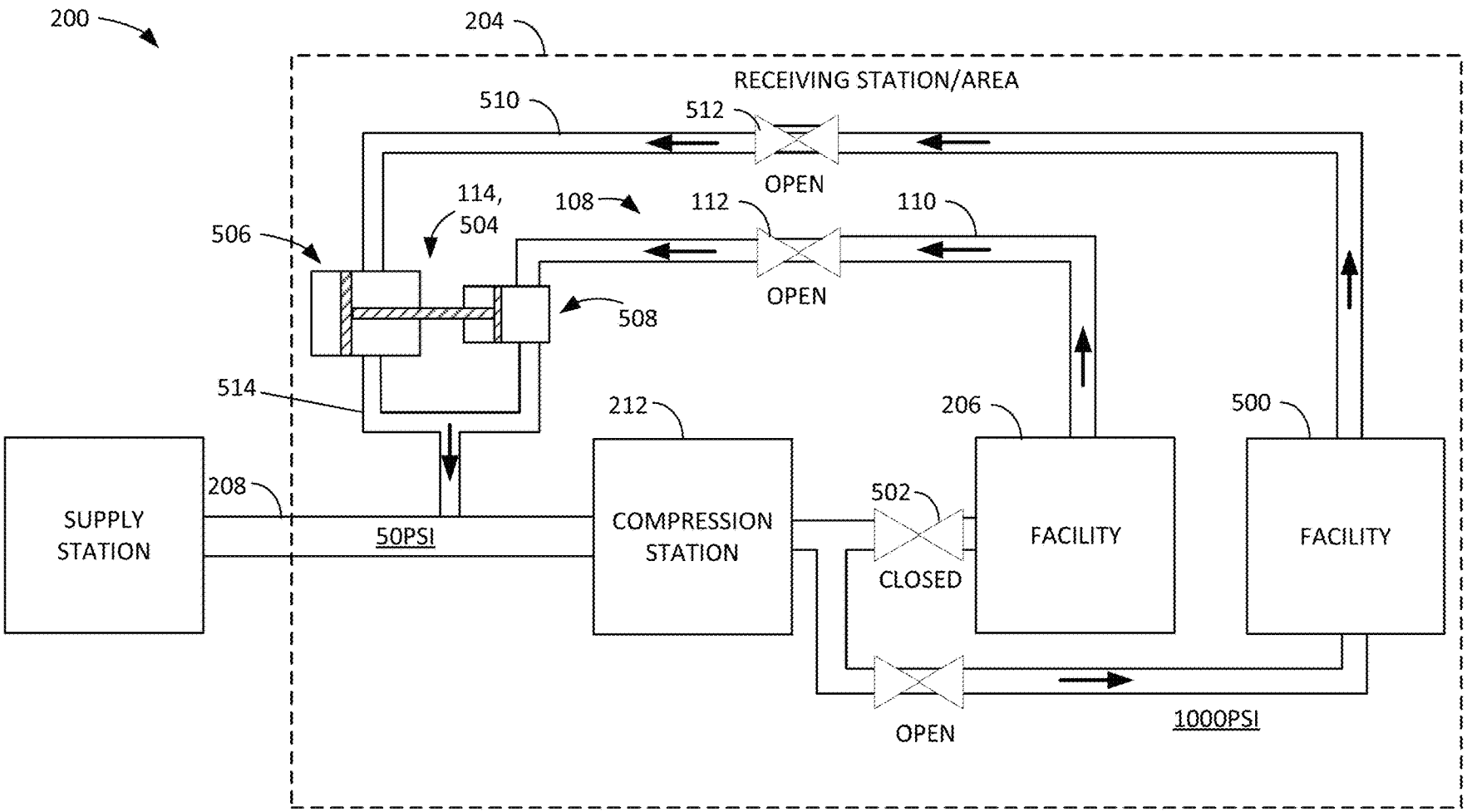
FIG. 5 is a schematic diagram of the example gas distribution network of FIG. 2A utilizing an example pneumatic pump.

In some examples, the pneumatic pump can be driven using natural gas from another line in the receiving station/area 204 having higher or lower pressure natural gas. For example, FIG. 5 shows an example schematic of the example network 200 similar to FIGS. 2A-2D. However, in this example, the receiving station/area 204 includes another facility 500 that receives high pressure natural gas from the compression station 212. The facility 500 may represent one or more components, equipment, pipes, etc. The receiving station/area 204 can include any number of facilities. To drain the facility 206, a first valve 502 (which is located upstream of the facility 206) is closed to isolate the facility 206 from the upstream compression station 212. Further, the valve 112 of the jumper line 108 is opened to enable the natural gas in the facility 206 to drain to the pipeline 208.

In the illustrated example of FIG. 5, the pump 114 is implemented as a pneumatic pump 504 that is driven by high pressure natural gas from the facility 500. The pump 114 has a driving side 506 and a driven side 508. In some examples, the driving side 506 of the pneumatic pump 504 is a single acting reciprocating pump or a double acting reciprocating pump. In the illustrated example, the network 200 includes an inlet pipe 510 fluidly coupled to the driving side 506 of the pneumatic pump 504. The inlet pipe 510 supplies high pressure natural gas (e.g., at 1000 psi) from the facility 500 to the driving side 506 of the pneumatic pump 504. The jumper pipe 110 is coupled to the driven side 508 of the pneumatic pump 504. When high pressure natural gas is supplied to the driving side 506, the driving side 506 drives the driven side 508 to move or pump the natural gas through the jumper pipe 110 to the pipeline 208. As disclosed above, the pneumatic pump 5044 can be activated to drain the remaining natural gas in the facility 206 down to zero or near zero pressure. In the illustrated example, a valve 512 is coupled to the pipe 510. In some examples, the pneumatic pump 504 is activated by opening the valve 512 to enable high pressure gas to drive the driving side 506 of the pneumatic pump 504. The valve 512 can be controlled by the valve control circuitry 124 of the control circuitry 116 (FIG. 1).

In some examples, the driving side 506 of the pneumatic pump 504 is vented to the pipeline 208. Therefore, the natural gas from the facility 500 that is used to drive the pneumatic pump 504 is not wasted (e.g., vented). For example, in the illustrated example of FIG. 5, the network 200 includes an outlet pipe 514 fluidly coupled between the driving side 506 and the jumper pipe 110 (downstream of the driven side 508), such that outlet gas from both sides of the pneumatic pump 504 are routed to the pipeline 208.

Figure 6:
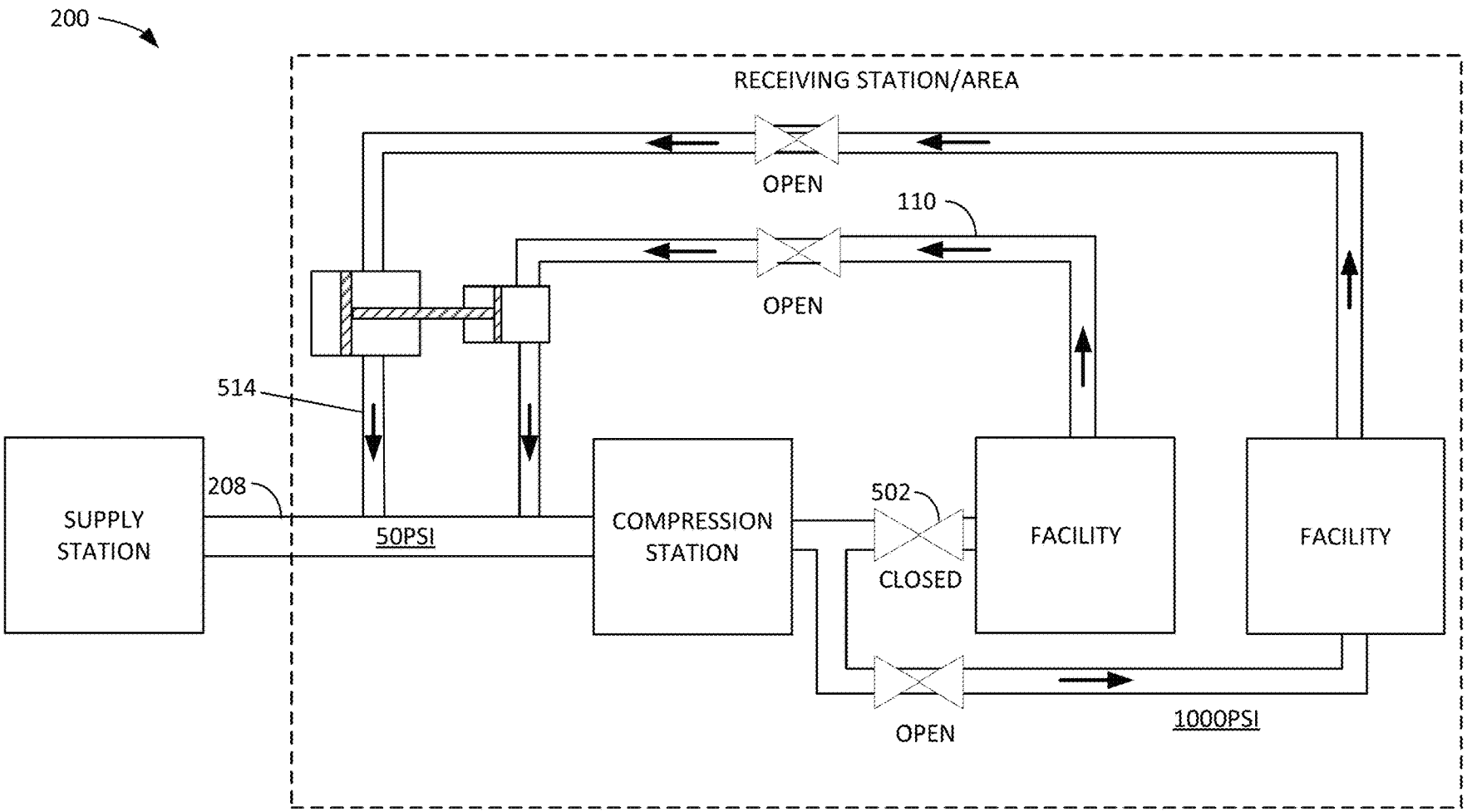
FIG. 6 is a schematic diagram of the example gas distribution network of FIG. 5 with an alternative pipe arrangement.

FIG. 6 shows a schematic diagram of the network 200 that is similar to FIG. 5. However, in FIG. 6, the outlet pipe 514 is not combined with the jumper pipe 110, but instead coupled directly to the pipeline 208.

Figure 7:
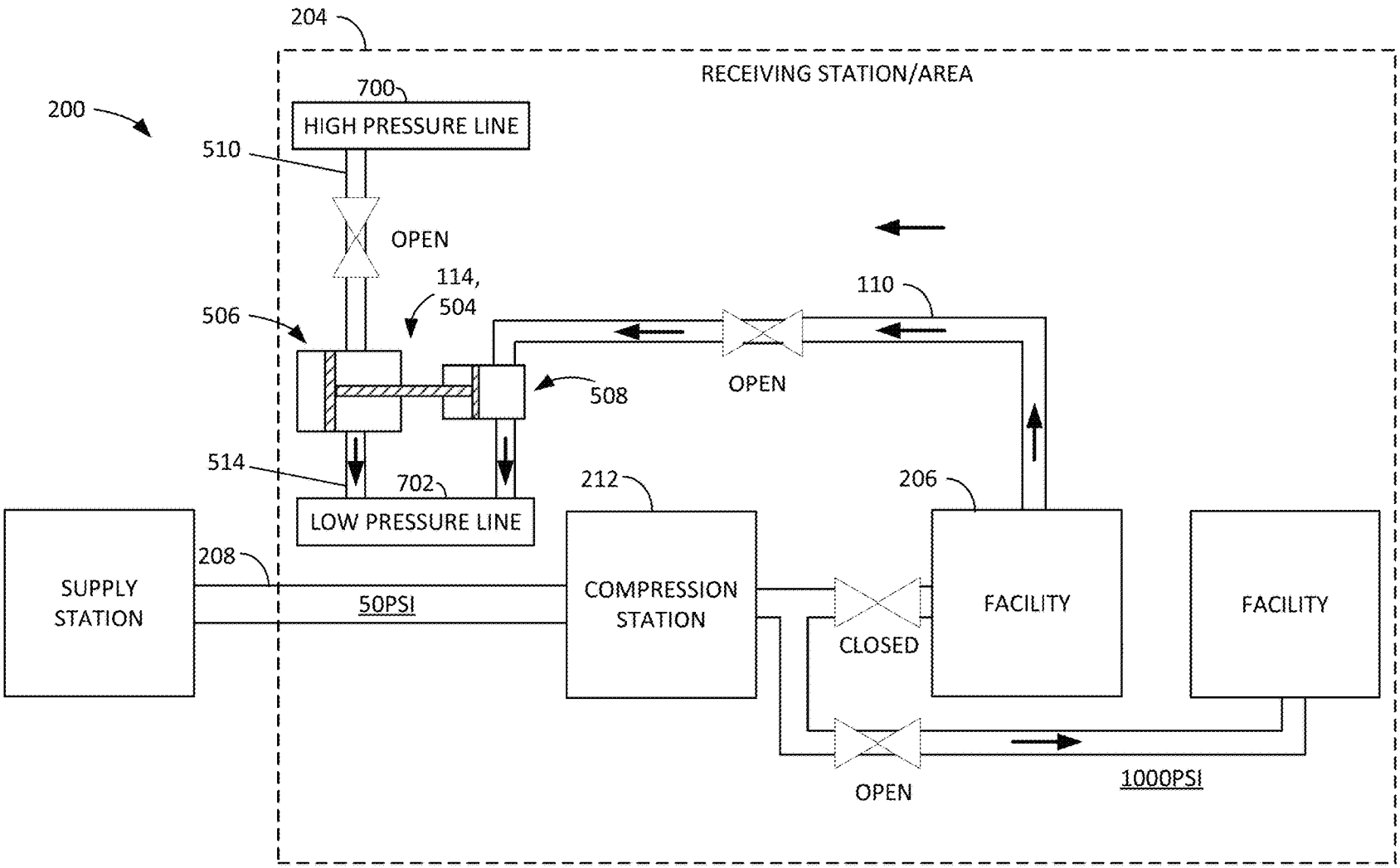
FIG. 7 is a schematic diagram of the example gas distribution network of FIG. 5 with another alternative pipe arrangement.

FIG. 7 shows a schematic diagram of the network 200 in which the pneumatic pump 500 is driven by natural gas from a separate pressurized source. For example, the receiving station/area 204 has a high pressure line 700 and a low pressure line 702. The high and low pressure lines 700, 702 can be separate from the compression station 212 and the facility 206. For example, the high and low pressure liens 700, 702 may be pressured by a different compression station and/or supplied by a different supply source. In this example, high pressure natural gas from the high pressure line 700 is routed by the inlet pipe 510 to the driving side 506 of the pneumatic pump 504 and the outlet pipe 514 routes the outlet gas to the low pressure line 702. Further in this example, the jumper pipe 110 routes the gas to the low pressure line 702.

Figure 8:
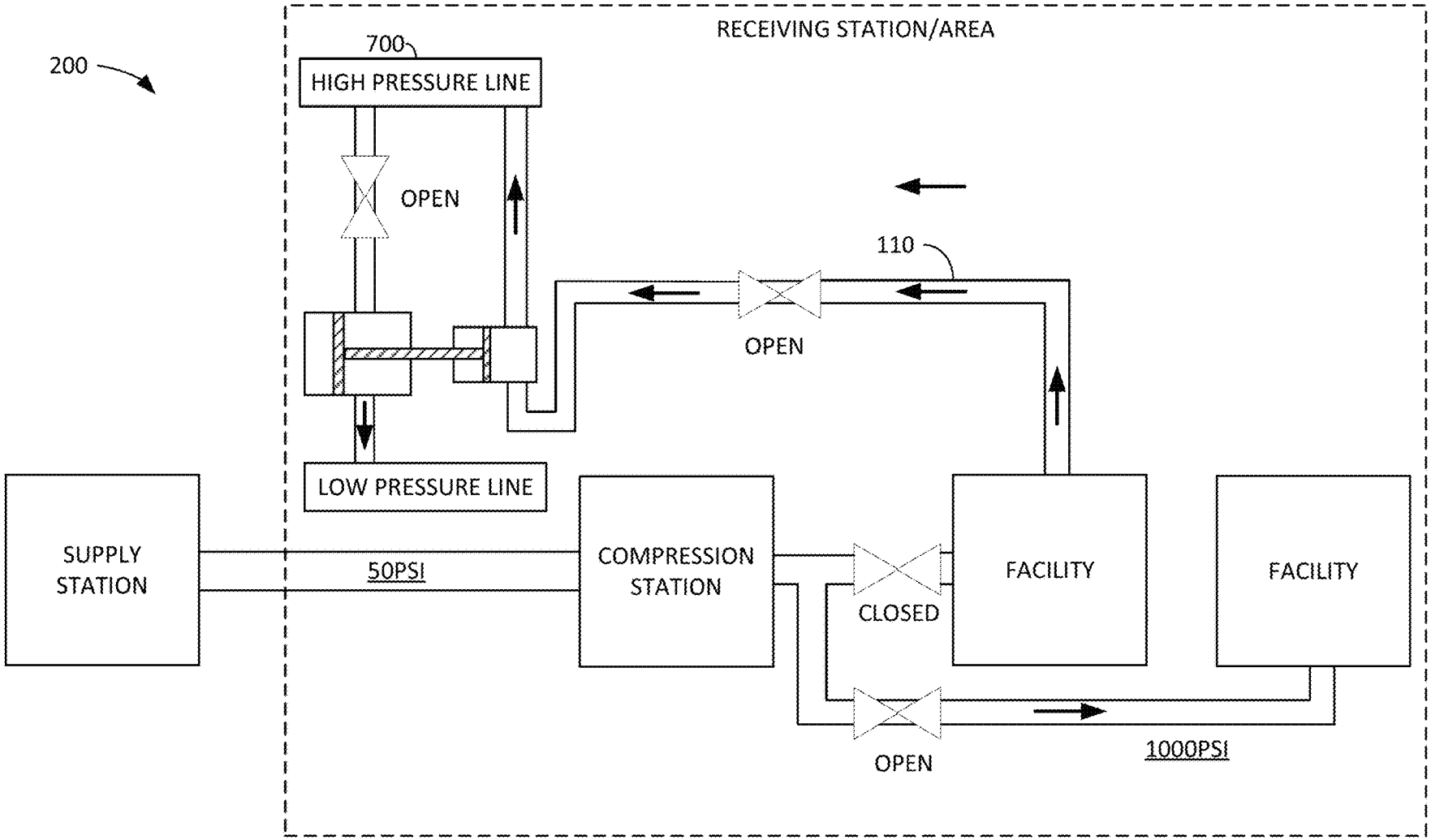
FIG. 8 is a schematic diagram of the example gas distribution network of FIG. 5 with another alternative pipe arrangement.

In other examples, the jumper line 110 can route the gas to the high pressure line 700. For example, FIG. 8 shows an example in which the jumper line 110 is routed to the high pressure line 700.

While an example implementation of the control circuitry 116 is illustrated in FIG. 1, one or more of the elements, processes, and/or devices illustrated in FIG. 1 may be combined, divided, re-arranged, omitted, eliminated, and/or implemented in any other way. Further, the example sensor interface circuitry 118, the example valve control circuitry 124, the example pump control circuitry 126, and/or, more generally, the example control circuitry 116 of FIG. 1, may be implemented by hardware alone or by hardware in combination with software and/or firmware. Thus, for example, any of the example sensor interface circuitry 118, the example valve control circuitry 124, the example pump control circuitry 126, and/or, more generally, the example control circuitry 116, could be implemented by processor circuitry, analog circuit(s), digital circuit(s), logic circuit(s), programmable processor(s), programmable microcontroller (s), graphics processing unit(s) (GPU(s)), digital signal processor(s) (DSP(s)), application specific integrated circuit (s) (ASIC(s)), programmable logic device(s) (PLD(s)), and/or field programmable logic device(s) (FPLD(s)) such as Field Programmable Gate Arrays (FPGAs). Further still, the example control circuitry 116 may include one or more elements, processes, and/or devices in addition to, or instead of, those illustrated in FIG. 1, and/or may include more than one of any or all of the illustrated elements, processes and devices.

Figure 9:
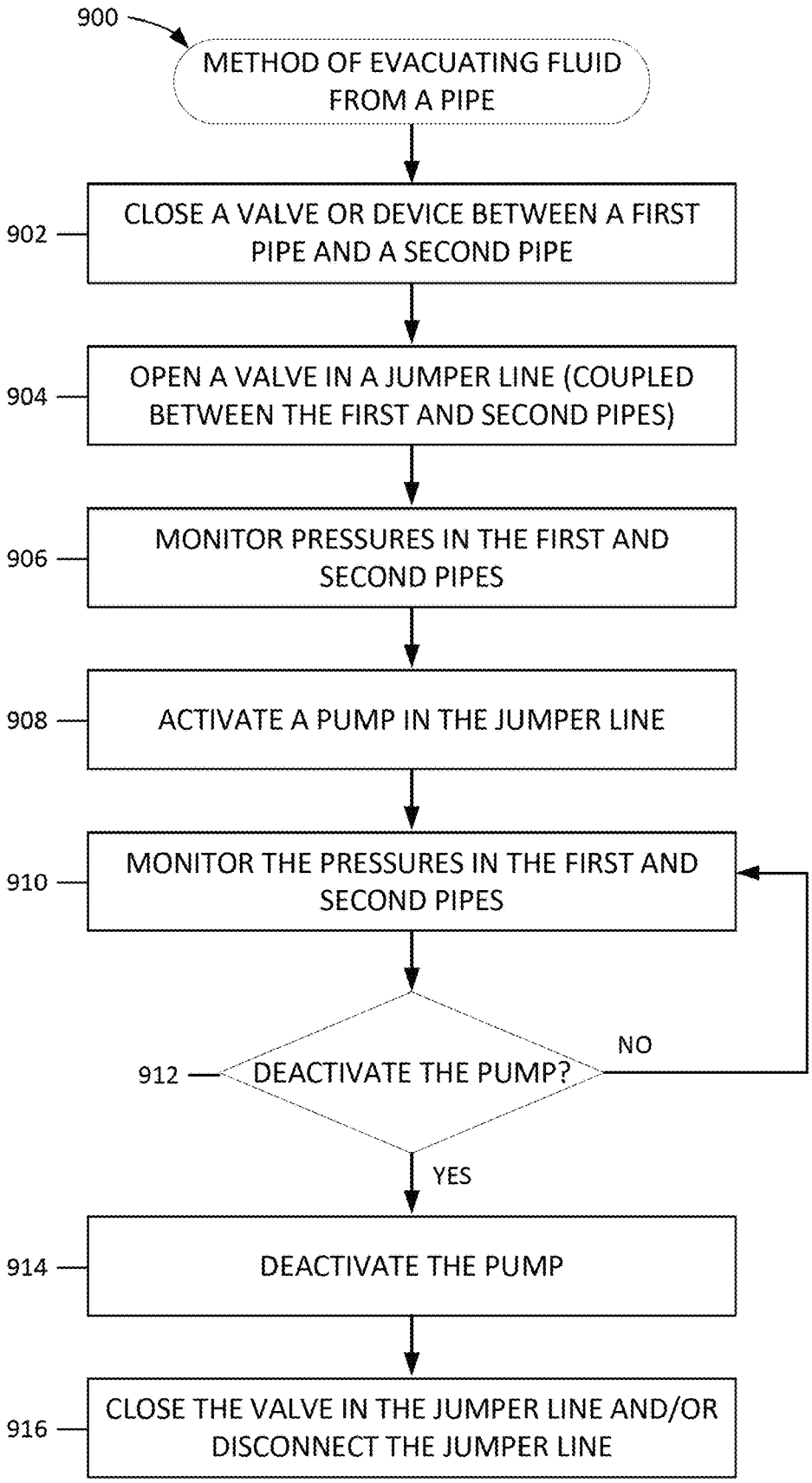
FIG. 9 is a flowchart representative of example machine readable instructions and/or example operations that may be executed by example processor circuitry to implement an example control circuitry of FIG. 1.

A flowchart representative of example machine readable instructions, which may be executed to configure processor circuitry to implement the control circuitry 116 of FIG. 1 is shown in FIG. 9. The machine readable instructions may be one or more executable programs or portion(s) of an executable program for execution by processor circuitry, such as the processor circuitry 912 shown in the example processor platform 900 discussed below in connection with FIG. 9. The program may be embodied in software stored on one or more non-transitory computer readable storage media such as a compact disk (CD), a floppy disk, a hard disk drive (HDD), a solid-state drive (SSD), a digital versatile disk (DVD), a Blu-ray disk, a volatile memory (e.g., Random Access Memory (RAM) of any type, etc.), or a non-volatile memory (e.g., electrically erasable programmable read-only memory (EEPROM), FLASH memory, an HDD, an SSD, etc.) associated with processor circuitry located in one or more hardware devices, but the entire program and/or parts thereof could alternatively be executed by one or more hardware devices other than the processor circuitry and/or embodied in firmware or dedicated hardware. The machine readable instructions may be distributed across multiple hardware devices and/or executed by two or more hardware devices (e.g., a server and a client hardware device). For example, the client hardware device may be implemented by an endpoint client hardware device (e.g., a hardware device associated with a user) or an intermediate client hardware device (e.g., a radio access network (RAN)) gateway that may facilitate communication between a server and an endpoint client hardware device). Similarly, the non-transitory computer readable storage media may include one or more mediums located in one or more hardware devices. Further, although the example program is described with reference to the flowchart illustrated in FIG. 9, many other methods of implementing the example control circuitry 116 may alternatively be used. For example, the order of execution of the blocks may be changed, and/or some of the blocks described may be changed, eliminated, or combined. Additionally or alternatively, any or all of the blocks may be implemented by one or more hardware circuits (e.g., processor circuitry, discrete and/or integrated analog and/or digital circuitry, an FPGA, an ASIC, a comparator, an operational-amplifier (op-amp), a logic circuit, etc.) structured to perform the corresponding operation without executing software or firmware. The processor circuitry may be distributed in different network locations and/or local to one or more hardware devices (e.g., a single-core processor (e.g., a single core central processor unit (CPU)), a multi-core processor (e.g., a multi-core CPU), etc.) in a single machine, multiple processors distributed across multiple servers of a server rack, multiple processors distributed across one or more server racks, a CPU and/or a FPGA located in the same package (e.g., the same integrated circuit (IC) package or in two or more separate housings, etc.).

The machine readable instructions described herein may be stored in one or more of a compressed format, an encrypted format, a fragmented format, a compiled format, an executable format, a packaged format, etc. Machine readable instructions as described herein may be stored as data or a data structure (e.g., as portions of instructions, code, representations of code, etc.) that may be utilized to create, manufacture, and/or produce machine executable instructions. For example, the machine readable instructions may be fragmented and stored on one or more storage devices and/or computing devices (e.g., servers) located at the same or different locations of a network or collection of networks (e.g., in the cloud, in edge devices, etc.). The machine readable instructions may require one or more of installation, modification, adaptation, updating, combining, supplementing, configuring, decryption, decompression, unpacking, distribution, reassignment, compilation, etc., in order to make them directly readable, interpretable, and/or executable by a computing device and/or other machine. For example, the machine readable instructions may be stored in multiple parts, which are individually compressed, encrypted, and/or stored on separate computing devices, wherein the parts when decrypted, decompressed, and/or combined form a set of machine executable instructions that implement one or more operations that may together form a program such as that described herein.

In another example, the machine readable instructions may be stored in a state in which they may be read by processor circuitry, but require addition of a library (e.g., a dynamic link library (DLL)), a software development kit (SDK), an application programming interface (API), etc., in order to execute the machine readable instructions on a particular computing device or other device. In another example, the machine readable instructions may need to be configured (e.g., settings stored, data input, network addresses recorded, etc.) before the machine readable instructions and/or the corresponding program(s) can be executed in whole or in part. Thus, machine readable media, as used herein, may include machine readable instructions and/or program(s) regardless of the particular format or state of the machine readable instructions and/or program(s) when stored or otherwise at rest or in transit.

The machine readable instructions described herein can be represented by any past, present, or future instruction language, scripting language, programming language, etc. For example, the machine readable instructions may be represented using any of the following languages: C, C++, Java, C#, Perl, Python, JavaScript, HyperText Markup Language (HTML), Structured Query Language (SQL), Swift, etc.

As mentioned above, the example operations of FIG. 5 may be implemented using executable instructions (e.g., computer and/or machine readable instructions) stored on one or more non-transitory computer and/or machine readable media such as optical storage devices, magnetic storage devices, an HDD, a flash memory, a read-only memory (ROM), a CD, a DVD, a cache, a RAM of any type, a register, and/or any other storage device or storage disk in which information is stored for any duration (e.g., for extended time periods, permanently, for brief instances, for temporarily buffering, and/or for caching of the information). As used herein, the terms non-transitory computer readable medium and non-transitory computer readable storage medium are expressly defined to include any type of computer readable storage device and/or storage disk and to exclude propagating signals and to exclude transmission media.

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc., may be present without falling outside the scope of the corresponding claim or recitation. As used herein, when the phrase "at least" is used as the transition term in, for example, a preamble of a claim, it is open-ended in the same manner as the term "comprising" and "including" are open ended. The term "and/or" when used, for example, in a form such as A, B, and/or C refers to any combination or subset of A, B, C such as (1) A alone, (2) B alone, (3) C alone, (4) A with B, (5) A with C, (6) B with C, or (7) A with B and with C. As used herein in the context of describing structures, components, items, objects and/or things, the phrase "at least one of A and B" is intended to refer to implementations including any of (1) at least one A, (2) at least one B, or (3) at least one A and at least one B. Similarly, as used herein in the context of describing structures, components, items, objects and/or things, the phrase "at least one of A or B" is intended to refer to implementations including any of (1) at least one A, (2) at least one B, or (3) at least one A and at least one B. As used herein in the context of describing the performance or execution of processes, instructions, actions, activities and/or steps, the phrase "at least one of A and B" is intended to refer to implementations including any of (1) at least one A, (2) at least one B, or (3) at least one A and at least one B. Similarly, as used herein in the context of describing the performance or execution of processes, instructions, actions, activities and/or steps, the phrase "at least one of A or B" is intended to refer to implementations including any of (1) at least one A, (2) at least one B, or (3) at least one A and at least one B.

As used herein, singular references (e.g., "a", "an", "first", "second", etc.) do not exclude a plurality. The term "a" or "an" object, as used herein, refers to one or more of that object. The terms "a" (or "an"), "one or more", and "at least one" are used interchangeably herein. Furthermore, although individually listed, a plurality of means, elements or method actions may be implemented by, e.g., the same entity or object. Additionally, although individual features may be included in different examples or claims, these may possibly be combined, and the inclusion in different examples or claims does not imply that a combination of features is not feasible and/or advantageous.

FIG. 9 is a flowchart representative of example machine readable instructions and/or example operations 900 that may be executed and/or instantiated by processor circuitry to implement an evacuation process using the example jumper line 108. The example machine readable instructions and/or example operations 500 are disclosed in connection with the network 100 shown in FIG. 1 to evacuate the contents (e.g., fluid) of the first pipe 102 to the second pipe 104. The example process can be similarly implemented in connection with network 200 shown in FIGS. 2A-2D, 5, 6, 7, and 8 and/or any other system or network. In some examples, the process begins with the jumper line 108 being connected between two pipes or pipe portions to bypass a valve or other device. For example, in FIG. 1, the jumper line is connected between the first and second pipes 102, 104 and bypasses the valve 106.

At block 902, the valve control circuitry 124 closes the valve 106 or maintains the valve 106 in the closed position. Additionally, one or more other devices between the first pipe 102 and the second pipe 104 can be closed or deactivated, such as pumps or regulators.

At block 904, the valve control circuitry 124 opens the valve 112 in the jumper pipe 110 of the jumper line 108. This allows or enables fluid to flow from the high pressure side (the first pipe 102) to the low pressure side (the second pipe 104) until the first pipe 102 is equalized with the second pipe 104. At block 906, the sensor interface circuitry 118 monitors the pressures in the first and second pipes 102, 104.

At block 908, the pump control circuitry 126 activates the pump 114 in the jumper pipe 110, which pumps at least some of the fluid from the first pipe 102 to the second pipe 104. Therefore, the pump 114 continues to pump or evacuate the fluid from the first pipe 102 to the second pipe 104, even after the pipes are equalized. At block 910, the sensor interface circuitry 118 continues to monitor the pressures in the first and second pipes 102, 104.

In some examples, the pump 114 is to be activated until a desired pressure is left in the first pipe 114. For example, it may be desired to remove all or almost all of the fluid from the first pipe 102. At block 912, the sensor interface circuitry 118 determines a pressure in the first pipe 102 and compares the pressure to a target pressure. The target pressure may be any pressure. If it is desired to completely evacuate the first pipe 102, the target pressure may be 0 psi or a pressure within a tolerance of 0 psi (e.g., 0.5 psi). In other examples, the target pressure can be a higher pressure, such as 10 psi. If the target pressure is not reached, control proceeds back to block 910 and the sensor interface circuitry 118 continues to monitor the pressures while the pump 114 continues to evacuate the fluid from the first pipe 102 to the second pipe 104. If the target pressure is reached, at block 914, the pump control circuitry 126 deactivates the pump 114. After the pump 114 is deactivated, at block 916, the valve control circuitry 124 closes the valve 112 and/or the jumper line 108 can be disconnected from the first and second pipes 102, 104.

Figure 10:
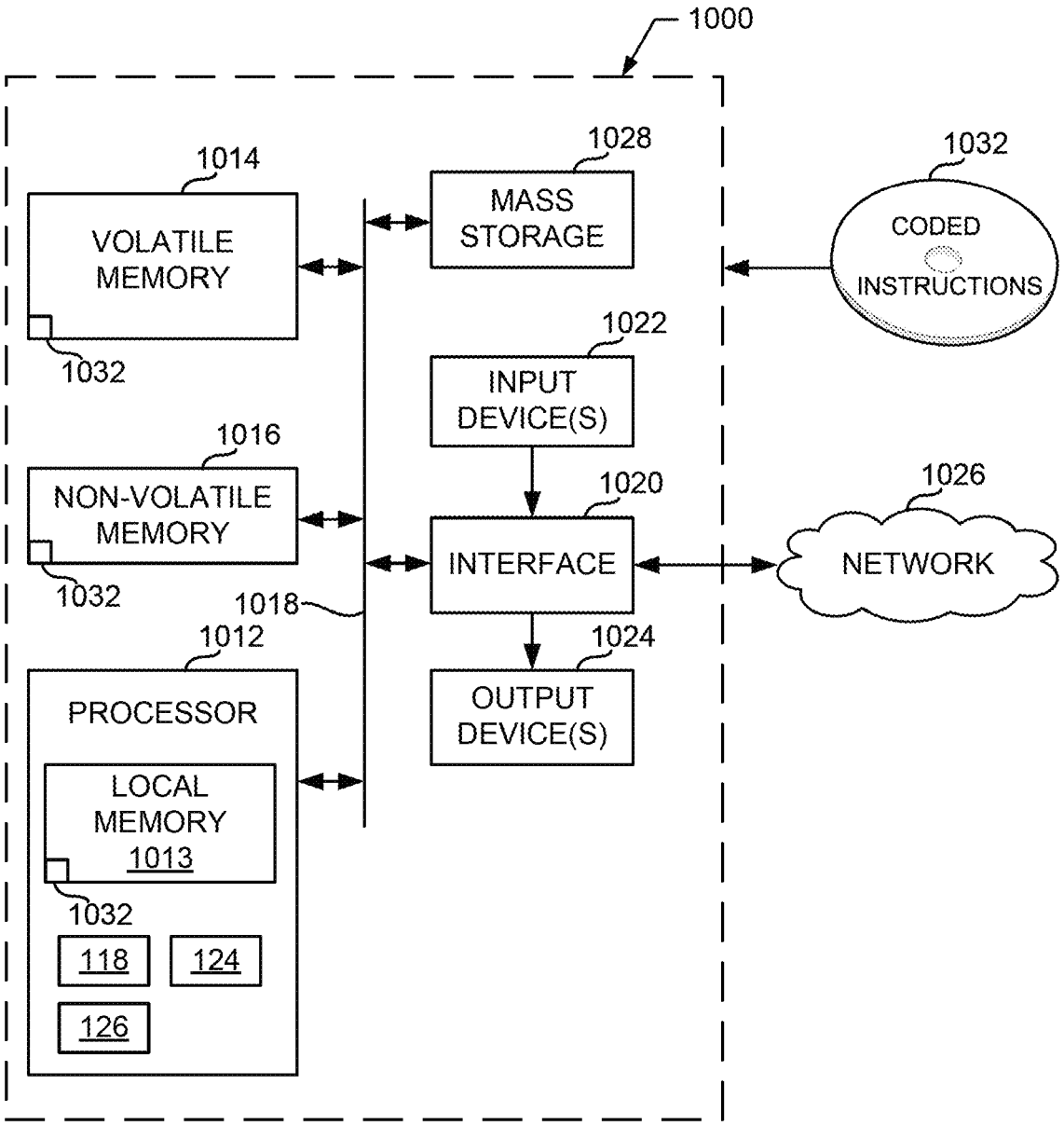
FIG. 10 is a block diagram of an example processing platform including processor circuitry structured to execute the example machine readable instructions and/or the example operations of FIG. 9 to implement the example control circuitry of FIG. 1.

FIG. 10 is a block diagram of an example processor platform 1000 structured to execute and/or instantiate the machine readable instructions and/or the operations of FIG. 9 to implement the control circuitry 116 of FIG. 1. The processor platform 1000 can be, for example, a server, a personal computer, a workstation, a self-learning machine (e.g., a neural network), a mobile device (e.g., a cell phone, a smart phone, a tablet such as an iPad™), a personal digital assistant (PDA), an Internet appliance, a DVD player, a CD player, a digital video recorder, a Blu-ray player, or any other type of computing device.

The processor platform 1000 of the illustrated example includes processor circuitry 1012. The processor circuitry 1012 of the illustrated example is hardware. For example, the processor circuitry 1012 can be implemented by one or more integrated circuits, logic circuits, FPGAs, microprocessors, CPUs, GPUs, DSPs, and/or microcontrollers from any desired family or manufacturer. The processor circuitry 1012 may be implemented by one or more semiconductor based (e.g., silicon based) devices. In this example, the processor circuitry 1012 implements the example sensor interface circuitry 118, the example valve control circuitry 124, and the example pump control circuitry 126.

The processor circuitry 1012 of the illustrated example includes a local memory 1013 (e.g., a cache, registers, etc.). The processor circuitry 1012 of the illustrated example is in communication with a main memory including a volatile memory 1014 and a non-volatile memory 1016 by a bus 1018. The volatile memory 1014 may be implemented by Synchronous Dynamic Random Access Memory (SDRAM), Dynamic Random Access Memory (DRAM), RAMBUS® Dynamic Random Access Memory (RDRAM®), and/or any other type of RAM device. The non-volatile memory 1016 may be implemented by flash memory and/or any other desired type of memory device. Access to the main memory 1014, 1016 of the illustrated example is controlled by a memory controller 1017.

The processor platform 1000 of the illustrated example also includes interface circuitry 1020. The interface circuitry 1020 may be implemented by hardware in accordance with any type of interface standard, such as an Ethernet interface, a universal serial bus (USB) interface, a Bluetooth® interface, a near field communication (NFC) interface, a Peripheral Component Interconnect (PCI) interface, and/or a Peripheral Component Interconnect Express (PCIe) interface.

In the illustrated example, one or more input devices 1022 are connected to the interface circuitry 1020. The input device(s) 1022 permit(s) a device and/or a user to enter data and/or commands into the processor circuitry 1012. The input device(s) 1022 can include the sensors 120, 122. Additionally or alternatively, the input device(s) 1022 can be implemented by, for example, an audio sensor, a microphone, a camera (still or video), a keyboard, a button, a mouse, a touchscreen, a track-pad, a trackball, an isopoint device, and/or a voice recognition system.

One or more output devices 1024 are also connected to the interface circuitry 1020 of the illustrated example. The output device(s) 1024 can be implemented by one or more actuators, pumps, valve, and/or other device, for instance. Additionally or alternatively, the output device(s) 1024 can be implemented, for example, by display devices (e.g., a light emitting diode (LED), an organic light emitting diode (OLED), a liquid crystal display (LCD), a cathode ray tube (CRT) display, an in-place switching (IPS) display, a touchscreen, etc.), a tactile output device, a printer, and/or speaker. The interface circuitry 1020 of the illustrated example, thus, typically includes a graphics driver card, a graphics driver chip, and/or graphics processor circuitry such as a GPU.

The interface circuitry 1020 of the illustrated example also includes a communication device such as a transmitter, a receiver, a transceiver, a modem, a residential gateway, a wireless access point, and/or a network interface to facilitate exchange of data with external machines (e.g., computing devices of any kind) by a network 1026. The communication can be by, for example, an Ethernet connection, a digital subscriber line (DSL) connection, a telephone line connection, a coaxial cable system, a satellite system, a line-of-site wireless system, a cellular telephone system, an optical connection, etc.

The processor platform 1000 of the illustrated example also includes one or more mass storage devices 1028 to store software and/or data. Examples of such mass storage devices 1028 include magnetic storage devices, optical storage devices, floppy disk drives, HDDs, CDs, Blu-ray disk drives, redundant array of independent disks (RAID) systems, solid state storage devices such as flash memory devices and/or SSDs, and DVD drives.

The machine executable instructions 1032, which may be implemented by the machine readable instructions of FIG. 9, may be stored in the mass storage device 1028, in the volatile memory 1014, in the non-volatile memory 1016, and/or on a removable non-transitory computer readable storage medium such as a CD or DVD.

From the foregoing, it will be appreciated that example systems, methods, apparatus, and articles of manufacture have been disclosed that enable a fluid to be evacuated from a higher-pressure location to a lower-pressure location using an active jumper line.

Examples and combinations of examples disclosed herein include the following:

Example 1 is a system comprising a first pipe having fluid at a first pressure a second pipe having fluid at a second pressure lower than the first pressure, and a jumper line including a jumper pipe coupled between the first pipe and the second pipe that bypasses a device between the first pipe and the second pipe and a valve coupled to the jumper pipe. The valve is to open to enable the fluid at the first pressure to evacuate to the second pipe until the first pipe is equalized with the second pipe. The jumper line also includes a pump coupled to the jumper pipe. The pump is to, when activated, move at least a portion of the fluid from the first pipe to the second pipe.

Example 2 includes the system of Example 1, wherein the device includes at least one of a valve, a compressor, or a regulator.

Example 3 includes the system of Examples 1 or 2, wherein the fluid in the first and second pipes is natural gas.

Example 4 includes the system of Example 3, wherein the pump is a pneumatic pump.

Example 5 includes the system of Example 4, further including a third pipe operably coupled to a driving side of the pneumatic pump. The third pipe is to supply high pressure natural gas to the driving side of the pneumatic pump.

Example 6 includes the system of Example 5, wherein the driving side of the pneumatic pump is vented to the second pipe.

Example 7 includes the system of Example 6, further including a fourth pipe fluidly coupled between the driving side of the pneumatic pump and the jumper pipe.

Example 8 includes the system of any of Examples 1-3, wherein the pump has an inline or axial configuration.

Example 9 includes the system of Example 8, wherein the pump includes a body defining an inlet and an outlet connected by a chamber, a first check valve at the inlet, a second check valve at the outlet, and a piston that is axially moveable in the chamber. The piston includes a third check valve. The piston is to move linearly in the chamber in a reciprocating action to pump fluid from the inlet to the outlet.

Example 10 includes the system of Example 9, wherein the piston is constructed of a magnetic or ferromagnetic material, and wherein the pump includes a coil surrounding the chamber, the coil to be activated to move the piston linearly in the chamber.

Example 11 includes the system of any of Examples 1-3, wherein the pump is a solenoid operated pump.

Example 12 is a method comprising closing a first valve or maintaining the first valve in a closed position. The first valve coupled between a first pipe having fluid at a first pressure and a second pipe having fluid at a second pressure lower than the first pressure. The method also includes opening a second valve of a jumper line. The jumper line includes a jumper pipe fluidly coupled between the first pipe and the second pipe that bypasses the first valve between the first pipe and the second pipe, wherein opening the second valve enables the fluid at the first pressure to flow from the first pipe to the second pipe until the first pipe is equalized with the second pipe. The method further includes activating a pump coupled to the jumper pipe to pump at least a portion of the fluid from the first pipe to the second pipe.

Example 13 includes the method of Example 12, further including determining a pressure in the first pipe and, when the pressure in the first pipe reaches a target pressure, deactivating the pump.

Example 14 includes the method of Examples 12 or 13, further including at least one of closing the second valve or disconnecting the jumper line from the first and second pipes.

Example 15 includes the method of any of Examples 12-14, wherein the fluid in the first and second pipes is natural gas, and wherein the pump is a pneumatic pump driven by high pressure natural gas supplied by a third pipe.

Example 16 is a system comprising a pipeline to supply fluid at a first pressure, a compression station to increase the fluid from the pipeline to a second pressure higher than the first pressure, a facility to receive and use the fluid at the second pressure, a jumper line fluidly coupled between the facility and the pipeline, the jumper line including a valve and a pump, and control circuitry. The control circuitry is to cause the valve to open to enable the fluid in the facility to evacuate to the pipeline until the facility is equalized with the pipeline and cause the pump to activate to move at least a portion of the fluid from the first pipe to the second pipe.

Example 17 includes the system of Example 16, wherein the valve is a first valve, further including a second valve upstream of the facility. The control circuitry is to cause the second valve to close prior to opening the first valve of the jumper line.

Example 18 includes the system of Examples 16 or 17, wherein the fluid is natural gas.

Example 19 includes the system of Example 18, wherein the pump is a pneumatic pump to be driven by high pressure natural gas.

Example 20 includes the system of Example 19, wherein the pneumatic pump has a driving side to the receive the high pressure natural gas, and wherein an outlet of the driving side of the pneumatic pump is vented to the pipeline.

Example 21 is a jumper line comprising a jumper pipe to be fluidly coupled between a first pipe having fluid at a first pressure and a second pipe having fluid at a second pressure lower than the first pressure. The jumper pipe is to bypasses a valve between the first pipe and the second pipe. The jumper line also includes a valve coupled to the jumper pipe. The valve is to open to enable the fluid at the first pressure to evacuate to the second pipe until the first pipe is equalized with the second pipe. The jumper line further includes a pump coupled to the jumper pipe. The pump is to, when activated, move at least a portion of the fluid from the first pipe to the second pipe.

Example 22 includes the jumper line of Example 21, wherein the pump is a pneumatic pump.

Example 23 includes the jumper line of Examples 21 or 22, wherein the pump has an inline or axial configuration.

Example 24 includes the jumper line of Example 23, wherein the pump includes a body defining an inlet and an outlet connected by a chamber, a first check valve at the inlet, a second check valve at the outlet, and a piston that is axially moveable in the chamber. The piston includes a third check valve. The piston is to move linearly in the chamber in a reciprocating action to pump fluid from the inlet to the outlet.

Example 25 includes the jumper line of any of Examples 21-24, wherein the pump is a solenoid operated pump.

The following claims are hereby incorporated into this Detailed Description by this reference. Although certain example systems, methods, apparatus, and articles of manufacture have been disclosed herein, the scope of coverage of this patent is not limited thereto. On the contrary, this patent covers all systems, methods, apparatus, and articles of manufacture fairly falling within the scope of the claims of this patent.

What is claimed is:

1. A system comprising:

a first pipe having natural gas at a first pressure;

a second pipe having natural gas at a second pressure lower than the first pressure;

a jumper line including:

a jumper pipe coupled between the first pipe and the second pipe that bypasses a device between the first pipe and the second pipe;

a valve coupled to the jumper pipe, the valve to open to enable the natural gas at the first pressure to evacuate to the second pipe until the first pipe is equalized with the second pipe; and a pneumatic pump coupled to the jumper pipe, the pneumatic pump having a driving side and a driven side, the driving side of the pneumatic pump to, when activated, drive the driven side of the pneumatic pump to move at least a portion of the natural gas from the first pipe to the second pipe; and a third pipe to supply high pressure natural gas to an inlet of the driving side of the pneumatic pump to drive the pneumatic pump, and wherein an outlet of the driving side of the pneumatic pump is vented to the second pipe such that the high pressure natural gas used to drive the pneumatic pump is vented to the second pipe.

2. The system of claim 1, wherein the device includes at least one of a valve, a compressor, or a regulator.

3. The system of claim 1, further including a fourth pipe fluidly coupled between the driving side of the pneumatic pump and the jumper pipe downstream of the driven side of the pneumatic pump.

4. A method comprising:

closing a first valve or maintaining the first valve in a closed position, the first valve coupled between a first pipe having natural gas at a first pressure and a second pipe having natural gas at a second pressure lower than the first pressure;

opening a second valve of a jumper line, the jumper line including a jumper pipe fluidly coupled between the first pipe and the second pipe that bypasses the first valve between the first pipe and the second pipe, wherein opening the second valve enables the natural gas at the first pressure to flow from the first pipe to the second pipe until the first pipe is equalized with the second pipe; and activating a pneumatic pump coupled to the jumper pipe to pump at least a portion of the natural gas from the first pipe to the second pipe, wherein the pneumatic pump is driven by high pressure natural gas from a third pipe, and wherein the pneumatic pump is fluidly coupled to the second pipe by a fourth pipe such that the high pressure natural gas used to drive the pneumatic pump is routed to the second pipe.

5. The method of claim 4, further including:

determining a pressure in the first pipe; and when the pressure in the first pipe reaches a target pressure, deactivating the pump.

6. The method of claim 4, further including at least one of closing the second valve or disconnecting the jumper line from the first and second pipes.

7. A system comprising:

a pipeline to supply fluid at a first pressure;

a compression station having one or more compressors to increase the fluid from the pipeline to a second pressure higher than the first pressure;

a facility to receive and use the fluid at the second pressure;

a jumper line fluidly coupled between the facility and the pipeline, the jumper line including a valve and a pump, the pump separate from the one or more compressors of the compression station; and control circuitry to:

cause the valve to open to enable the fluid in the facility to evacuate to the pipeline until the facility is equalized with the pipeline; and cause the pump to activate to move at least a portion of the fluid from the facility to the pipeline.

8. The system of claim 7, wherein the valve is a first valve, further including a second valve upstream of the facility, the control circuitry to cause the second valve to close prior to opening the first valve of the jumper line.

9. The system of claim 7, wherein the fluid is natural gas.

10. The system of claim 9, wherein the pump is a pneumatic pump to be driven by high pressure natural gas.

11. The system of claim 10, wherein the pneumatic pump has a driving side to receive the high pressure natural gas, and wherein an outlet of the driving side of the pneumatic pump is vented to the pipeline.

* * * * *